United States Patent [19]

Boliver

[11] 3,997,235

[45] Dec. 14, 1976

[54] SHIELDED POWER CABLE SEPARABLE CONNECTOR MODULE WITH SNUFFER LINER HAVING REDUCED ARC-QUENCHING GAS GENERATING PORTION

[75] Inventor: Vincent J. Boliver, Pittsfield, Mass.

[73] Assignee: General Electric Company, N.Y.

[22] Filed: Mar. 27, 1975

[21] Appl. No.: 562,566

[52] U.S. Cl. ..... 339/111; 174/18; 174/154; 200/149 A; 339/143 R

[51] Int. Cl.[2] ..... H01R 13/52

[58] Field of Search ..... 339/111, 101, 143, 60; 174/154, 152, 73, 18; 200/149.1, 51, 150

[56] References Cited

UNITED STATES PATENTS 3,654,590 4/1972 Brown ..... 339/111

*Primary Examiner*—Roy Lake
*Assistant Examiner*—DeWalden W. Jones
*Attorney, Agent, or Firm*—Volker R. Ulbrich

[57] ABSTRACT

A separable connector module for connecting shielded electrical power cable and of the type including an insulating housing containing a bore contact assembly. The bore assembly includes a set of resilient receiving contact fingers attached to a rigid snuffer tube having on its inside wall a liner of ablative material. The improvement comprises that the portion of the snuffer liner adjacent the contacts is counterbored to have a greater inside diameter than the remaining portion of the snuffer liner. Such counterboring improves the performance of the connector for capacitive switching at relatively high voltages and in addition reduces the tendency for clear and restrike failures on typical distribution circuits.

4 Claims, 2 Drawing Figures

SHIELDED POWER CABLE SEPARABLE CONNECTOR MODULE WITH SNUFFER LINER HAVING REDUCED ARC-QUENCHING GAS GENERATING PORTION

BACKGROUND OF THE INVENTION

The present invention relates generally to electrical cable connectors and relates particularly, but not exclusively, to separable connector modules for connecting together the operating components of an underground power distribution system by means of shielded electrical cable.

Separable connector assemblies for underground power distribution cable, or shielded cable, are watertight when assembled and may be readily separated into two or more units to break a cable connection. As such units are available separately commercially for various reasons and are individually subject to special design considerations, they are commonly referred to as "modules". Thus, a connection includes two or more matching modules assembled together.

One type of separable connector commonly used is a "rod and bore" switching type. A switch module having a receiving bore tube, or snuffer, situated within a passageway in a shielded, insulating housing and a grasping contact member at the interior end of the bore tube receives a matching rod connector module having a rod contact which is inserted in the bore and grasped by the bore contact member. Examples of this type of connector are described, for example, in the following U.S. Pat. Nos.:

3,513,437 issued 19 May 1970 to W. A. Morris
3,542,986 issued 24 Nov. 1970 to E. J. Kotski
3,551,587 issued 29 Dec. 1970 to R. F. Propst, and
3,587,035 issued 22 June 1971 to E. J. Kotski It is desirable to be able to operate such connectors while their cables are energized to interrupt the power. As the cables are generally carrying power at a voltage on the order of thousands of volts, separation of the contacts of the connector on a live cable results in the formation of an electric arc between the contacts. The arc will, unless promptly extinguished, eventually strike a ground plane such as the grounded shielding of the modules, and create a direct line-to-ground fault.

In the present connectors, the bore of a snuffer tube is lined with ablative material, a material which generates arc-extinguishing gases when subjected to an electric arc. An arc follower, a rod-shaped extension at the end of the metal contact rod and generally somewhat smaller in diameter than the rod, is also of ablative material. When the contact rod is pulled from the contact member of the bore module, the resulting arcing passes between the follower and the snuffer liner. The exposure of the ablative material to arcing causes it to generate arc-extinguishing gases which rapidly extinguish the arc. This permits the connector to be utilized as a switch by being operated under live conditions, without creating a line-to-ground fault.

There are certain failure modes associated with connectors of the type described above, and these failure modes relate, among other things, to the type of circuit which the connector is called upon to interrupt.

When the connector is interrupting a normal distribution circuit, there may simply be a failure to extinguish to arc as the rod is pulled from the bore. This will eventually establish arcing to a nearby ground plane surface. There may also occur a momentary clearing of the current as the rod is pulled from the bore, with a later restriking of the arc to a ground plane as the rod is fully removed from the bore and hot, ionized gases rush out of the bore in a conducting and unconfined state and establish a conducting path from the contacts to the shielding or other ground plane.

When the connector is interrupting a highly capacitive circuit, on the other hand, there can occur a different type of failure mode involving a restrike of the contacts. In this mode there is a momentary clearing of the current when the contacts are first separated, with a restriking of the arc between the contacts shortly thereafter. Such clearing and restriking may occur repeatedly as the contacts are separated until the arc between the contacts eventually finds a nearby ground plane. This mode will be described in more detail later.

SUMMARY OF THE INVENTION

The present invention is a novel connector module of the type having a set of receiving contacts located at one end of a snuffer tube that is lined with ablative material. The improvement comprises that the snuffer liner comprises a portion adjacent the contacts which has a reduced gas-generating capability relative to the remaining portion of the liner.

A novel connector module, in addition to having the capability of switching normal loads, can also switch capacitive loads without generating a contact restrike fault.

DESCRIPTION OF THE PREFERRED EMBODIMENT

Figure 1:
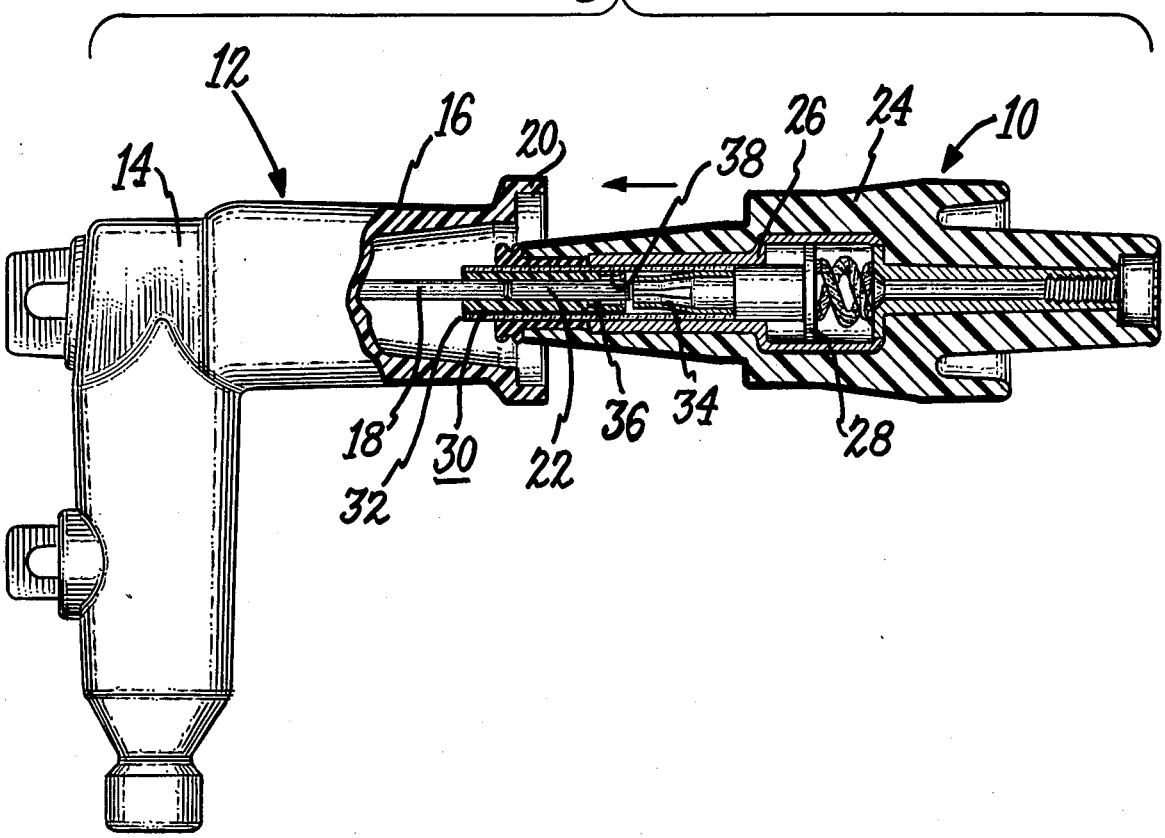
FIG. 1 is a partially sectioned view of a separable connector switch module of the bore type in accordance with a preferred embodiment of the invention, in partial engagement with a matching rod connector module to illustrate the manner of their interconnection.

A preferred embodiment of the invention is the separable connector switch module 10 of the bore type shown in FIG. 1 together with a matching rod connector module 12 to illustrate the manner of their interconnection.

The rod module 12 has an elastomeric housing 14 provided on its outside surface with a conductive shield layer 16, which is grounded. A metal contact rod 18 extends from within the housing 12 into a cup-shaped gas shield 20 of the housing 14. At the end of the metal contact rod 18 extends a rod follower 22 of ablative material such as a filled cycloaliphatic epoxy. The metal contact rod 18 itself is connected to the conductor of the power cable inside the housing 14 by threading into a metal rod support member inside the housing 14.

The switch module 10 is designed to be mated with the rod module 12 on one end and to be rigidly mounted at the other end into a bushing well such as, for instance might be in a transformer housing or switch housing wall. The switch module 10 comprises an insulating housing 24 of EPDM (ethylene-propylene-dienemonomer) rubber in which there is embedded a metal sleeve 26 having receiving threads for a mounting stud at one end to hold the module 10 in place in the bushing well, and having at its other end a metal sleeve 26 defining an elongated rod-receiving passageway. That portion of the switch module housing 24 surrounding the sleeve 26 is a truncated cone which closely matches the configuration of the inside of the gas shield 20 of the rod module housing 14 to form a watertight electrically insulating seal when the two modules 10, 12 are joined.

At the end of the interior end of the sleeve 26 inside the switch module housing 24 is a gas-actuated piston 28. Rigidly attached to the piston 28 by means of a thread engagement is a snuffer assembly 30.

Figure 2:
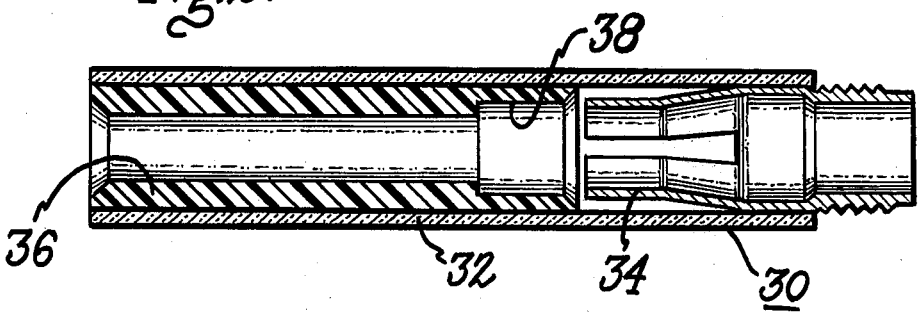
FIG. 2 is a side sectional view of a snuffer assembly of the bore module of FIG. 1.

The snuffer assembly 30, shown in greater detail in FIG. 2, includes an insulating snuffer tube 32 having attached to it at the innermost end a set of resilient-fingered metal rod-receiving contacts 34. The inside wall of the snuffer tube 32 is provided with an ablative snuffer liner 36 of a filled cycloaliphatic about 0.38 cm (centimeters) thick with an inside diameter of about 1.29 cm.

The snuffer liner 36 has a counterbored annular portion 38 with a diameter of about 1.74 cm extending a distance of about 0.63 cm from the inside end of the liner 36 adjacent the contacts 34. The counterbored portion 38 reduces the initial generation of gas upon separation of the contacts rod 18 from the contacts 34 to contact restrike failure modes upon switching of capacitive loads, and also to reduce the likelihood of a restrike to ground when interrupting a normal distribution circuit.

GENERAL CONSIDERATIONS

The novel connector results in improved performance in the interruption of normal distribution circuits by reducing the total amount of arc-generated gas to prevent the type of failure mode in which there is a direct restrike to ground due to dielectric breakdown of the escaping hot gases. Moreover, the reduction in gas generation is made selectively during the initial separation of the contacts, so that the interrupting characteristics of the remaining structure are relatively unaffected. It was found that while it is necessary to generate some gas initially, the initial amount generated by a liner of uniform diameter extending all the way to the contacts was excessive, and actually contributed to the likelihood of a restrike to ground failure. The counterbored portion of the liner permits control of the amount of gas generated initially, while effecting no change in the critical dimensions of that part of the bore lining which determine the desired clearing characteristics of the module as the contacts become separated further.

The improved performance of the novel switch module for capacitive switching is believed also attributable to the reduced initial volume of arc-quenching gas generated immediately after the separation of the rod and bore contacts. It is known to those of ordinary skill in the art of power distribution circuit switching that when a capacitive load is interrupted momentarily for a period of time less than a cycle, there can occur phenomenon known as a "voltage doubling".

In a capacitive circuit, the current leads the voltage by 90°. Thus, as the contacts are separated, the recovery voltage, that being the voltage across the contacts after current interruption, is zero at the instant of current zero for a capacitive load, since the capacitor voltage at a current zero must be equal and opposite the supply voltage. Consequently, the current can readily be temporarily cleared or interrupted. One half cycle later, however, twice the peak voltage appears across the contacts if a restrike does not occur between the contacts prior to that time. A restrike between the contacts multiplies the voltage across the contacts and can increase with each temporary clear-and-restrike until failure occurs by an arcing to an adjacent ground plane.

The foregoing chain of events can be prevented by reducing the generation of gas during the initial contact separation to prevent a temporary clearing until there is sufficient contact separation to withstand the recovery voltage across the contacts so that no restrike can occur between the contacts. This is accomplished by a novel connector module of the preferred embodiment by the counterbored portion of the snuffer liner, which reduces initial confinement of the arc to reduce the generation of gas. The length of the counterbored portion of the liner for a given known ablative material and connector configuration on a particular capacitive circuit can be determined by taking into consideration the required withstand voltage for permanent clearing and the dielectric properties of the gas generated by the ablative material.

While in the preferred embodiment the means for reducing the initial generation of gas in the snuffer tube was by a counterbore in the liner, various other means can be used to accomplish this result while still being within the scope of the present invention. For example, the counterbored portion of the liner could be replaced by a section of liner the same diameter as the remainder of the liner, but of a different ablative material which generates gas at a lesser rate. Or, arc confinement in the first portion of the liner can be reduced by changing the configuration of that portion other than by counterboring. For example, the portion could be tapered, or provided with grooves to increase the effective diameter.

Counterboring of the liner was found to be particularly advantageous because of the ease of manufacturing. The counterbored portion should be of relatively uniform diameter and extend about 0.63 cm along the axis of the snuffer from the female contacts for the dimensions and ablative material of the preferred embodiment.

While in the preferred embodiment of the invention the separable connection is by connector modules, the present invention can also be used in other types of circuit interruption apparatus which makes use of a rod and bore contacts with ablative material lining the bore.

I claim:

1. Apparatus for connecting electrical power cable, the apparatus being of the type having a bore contact assembly for receiving a rod contact and rod contact follower, the bore contact assembly including a snuffer tube with a set of female contact members located at one end and a liner of ablative material on the inside wall of the tube, wherein the improvement comprises:

said ablative liner comprises an annular portion along the axis of the sleeve adjacent the contacts, which generates arc-quenching gas at a lesser rate on separation of said contacts than do other, remaining portion of said liner, said annular portion having a greater effective inside diameter than does the major remaining portion of said liner.

2. The subject matter of claim 1 wherein said apparatus is a bore connector module for separably connecting shielded electrical power cable, and wherein said module comprises an insulating housing containing a female bore assembly support;

a female bore assembly, including a set of metal female contact fingers at one end of a tubular member fitted into a passageway in said insulating housing and fixed to said support, and a liner of ablative material inside said sleeve and extending along a major portion of the axis of said sleeve.

3.The apparatus of claim 2 wherein said support is a gas-actuated piston.

4. The subject matter of claim 1 wherein said apparatus is a bore connector switch module for separably connecting shielded electrical power cable, and wherein said module comprises an insulating housing containing a female bore assembly support in the form of a gas-actuated piston;

a female bore assembly, including a set of metal female contact fingers at one end of a tubular snuffer member fitted into a passageway in said insulating housing and fixed to said support, and a liner of ablative material inside said sleeve and extending along a major portion of the axis of said sleeve, wherein the improvement comprises that:

said liner of ablative material comprises an annular portion adjacent said contacts which is of ablative material with less effective arc-quenching gas generating capability than the ablative material comprising the remainder of said liner.

* * * * *